US007226899B2

(12) United States Patent
Cole et al.

(10) Patent No.: US 7,226,899 B2
(45) Date of Patent: Jun. 5, 2007

(54) FIBROUS MATRIX OF SYNTHETIC DETERGENTS

(75) Inventors: Douglas B. Cole, Elkhart Lake, WI (US); James Cotter, Waupaca, WI (US); Fred Ashenbrenner, Appleton, WI (US); Bruce Siebers, Kimberly, WI (US); James McManus, Hortonville, WI (US)

(73) Assignee: Kimberly - Clark Worldwide, Inc., Neenah, WI (US)

( * ) Notice: Subject to any disclaimer, the term of this patent is extended or adjusted under 35 U.S.C. 154(b) by 291 days.

(21) Appl. No.: 10/745,330

(22) Filed: Dec. 23, 2003

(65) Prior Publication Data

US 2005/0137115 A1 Jun. 23, 2005

(51) Int. Cl.
*C11D 17/00* (2006.01)

(52) U.S. Cl. ..... 510/296; 510/218; 510/276; 510/438

(58) Field of Classification Search ..... 510/295, 510/296, 438, 276, 218
See application file for complete search history.

(56) References Cited

U.S. PATENT DOCUMENTS

| | | | | |
|---|---|---|---|---|
| 3,632,396 | A * | 1/1972 | Perez-Zamora | 442/102 |
| 3,838,186 | A | 9/1974 | Ahrens | |
| 3,931,031 | A | 1/1976 | Willard | |
| 3,954,642 | A * | 5/1976 | Schwuger | 15/104.93 |
| 4,515,703 | A | 5/1985 | Haq | |
| 4,557,852 | A | 12/1985 | Schulz et al. | |
| 4,652,390 | A | 3/1987 | Strampach et al. | |
| 4,654,395 | A | 3/1987 | Schulz et al. | |
| 4,765,916 | A | 8/1988 | Ogar et al. | |
| 4,801,636 | A | 1/1989 | Smith et al. | |
| 4,814,099 | A | 3/1989 | Lloyd | |
| 4,853,142 | A | 8/1989 | Win et al. | |
| 4,919,835 | A | 4/1990 | Sigl et al. | |
| 4,938,888 | A | 7/1990 | Kiefer et al. | |
| 4,948,585 | A | 8/1990 | Schlein | |
| 5,030,375 | A | 7/1991 | Sigl et al. | |
| 5,053,157 | A | 10/1991 | Lloyd | |
| 6,130,193 | A | 10/2000 | Gillette | |
| 6,248,703 | B1 | 6/2001 | Finucane et al. | |
| 6,613,732 | B2 * | 9/2003 | Suazon et al. | 510/438 |
| 2002/0034481 | A1 | 3/2002 | Bianchi et al. | |
| 2003/0035951 | A1 | 2/2003 | Magill et al. | |
| 2003/0195135 | A1 | 10/2003 | Boeckh et al. | |

FOREIGN PATENT DOCUMENTS

| | | | |
|---|---|---|---|
| EP | 0011502 | A1 | 5/1980 |
| EP | 0211773 | A2 | 2/1987 |
| EP | 0296813 | A1 | 12/1988 |
| EP | 0316726 | A3 | 5/1989 |
| EP | 0744147 | A1 | 11/1996 |
| EP | 0885289 | B1 | 1/1997 |
| EP | 0617733 | B1 | 4/1997 |
| EP | 0845028 | B1 | 1/2000 |
| EP | 1186650 | | 3/2002 |
| EP | 0973858 | B1 | 7/2003 |
| JP | 02161925 | A2 | 6/1990 |
| JP | 02169755 | A | 6/1990 |
| JP | 03076900 | A2 | 4/1991 |
| JP | 04004300 | A2 | 1/1992 |
| JP | 05117699 | A2 | 5/1993 |
| JP | 05156300 | A2 | 6/1993 |
| JP | 07053207 | A2 | 2/1995 |
| JP | 08060199 | A2 | 3/1996 |
| JP | 09087691 | A2 | 3/1997 |
| JP | 10000176 | A2 | 1/1998 |
| JP | 10165344 | A2 | 6/1998 |
| JP | 03138765 | B2 | 9/1998 |
| JP | 10272082 | A2 | 10/1998 |
| JP | 11021594 | A2 | 1/1999 |
| JP | 11228998 | A2 | 8/1999 |
| JP | 11343500 | A2 | 12/1999 |
| JP | 2001003249 | | 1/2001 |
| JP | 2001089797 | | 4/2001 |
| JP | 2001198065 | A2 | 7/2001 |
| JP | 2001262197 | | 9/2001 |
| JP | 2001262198 | A2 | 9/2001 |
| JP | 2001354098 | | 9/2001 |
| JP | 2001294899 | | 10/2001 |
| JP | 04072180 | A2 | 4/2002 |
| JP | 2002105499 | A2 | 4/2002 |
| JP | 03300621 | B2 | 7/2002 |
| JP | 2002235098 | | 8/2002 |
| WO | WO-99/27066 | A1 | 6/1999 |
| WO | WO-01/85888 | | 11/2001 |

OTHER PUBLICATIONS

"International Search Report and Written Opinion of the International Searching Authority, or the Declaration, for Application No. PCT/US2004/026916, date mailed Jan. 31, 2005", 13 pages.

"Mfg. high water absorption fibre compression mounlding—by imparting surfactant to the fibre, humidifying, forming into sheet and compressing", *WPI/Derwent Publication*, Abstract XP002313671,(Jun. 29, 1990).

* cited by examiner

*Primary Examiner*—Lorna M. Douyon
(74) *Attorney, Agent, or Firm*—Schwegman, Lundberg, Woessner, & Kluth, P.A.

(57) ABSTRACT

The present invention relates to a fibrous matrix of synthetic detergents. The fibrous matrix includes fibers formed of a synthetic wax and a primary surfactant embedded in the fibers. The fibrous matrix further includes a secondary surfactant embedded in the fibers.

15 Claims, 4 Drawing Sheets

FIBROUS MATRIX OF SYNTHETIC DETERGENTS

FIELD OF THE INVENTION

This invention relates to a composition and method for delivering a pre-determined amount of synthetic detergents, and in particular to compositions and methods for forming fibers of synthetic detergents.

BACKGROUND OF THE INVENTION

Synthetic detergents are used to clean many common items (e.g., dishes or laundry). The synthetic detergents are typically in granulated, powdered, solid or liquid form.

One drawback with using liquid detergents is that they are heavy and bulky making them difficult to manipulate and transport. Liquid detergents are also easily spilled as the detergents are stored for shipment, or placed into a device (e.g., clothes washer) to perform cleaning.

The powdered or granulated detergents are composed of finely divided particles that are difficult to measure and/or dispense. In addition, the powdered or granulated detergents are usually messy, and when inhaled may pose a potential health hazard.

SUMMARY OF THE INVENTION

This invention provides a convenient and cost-effective method for delivering a pre-determined amount of synthetic detergents. The synthetic detergents are formed into fibers that may be inter-connected into a fibrous matrix. The fibrous matrix of synthetic detergents is made to be added to water, or some other liquid, to form cleaning compositions.

Some example applications include adding the fibrous matrix of synthetic detergents to laundry wash water and dish cleaning water. In some forms, the sheets of synthetic detergents may include color brighteners, bleaches, fabric softeners and anti-static materials, or any other ingredient that makes the fibrous matrix suitable for commerce, including any combination thereof.

The present invention relates to a composition for forming fibers of synthetic detergents. The composition includes a synthetic wax and a primary surfactant added to the synthetic wax. The composition further includes a secondary surfactant added to the synthetic wax.

In another form, the present invention relates to a method for developing fibers of synthetic detergents. The method includes adding a primary surfactant to a synthetic wax, and adding a secondary surfactant to the synthetic wax. The method further includes forming the synthetic wax into fibers.

In another example form, the present invention relates to a fiber. The fiber includes a synthetic wax and a primary surfactant that is embedded in the synthetic wax. The fiber further includes a secondary surfactant that is embedded in the synthetic wax.

In yet another form, the present invention relates to a fibrous matrix of synthetic detergents. The fibrous matrix includes fibers formed of a synthetic wax and a primary surfactant that is embedded in the fibers. The fibrous matrix further includes a secondary surfactant that is embedded in the fibers.

BRIEF DESCRIPTION OF THE DRAWINGS

The above-mentioned and other features will become more apparent and better understood by reference to the following description of the invention taken in conjunction with the accompanying drawings.

DEFINITIONS

Figure 1:
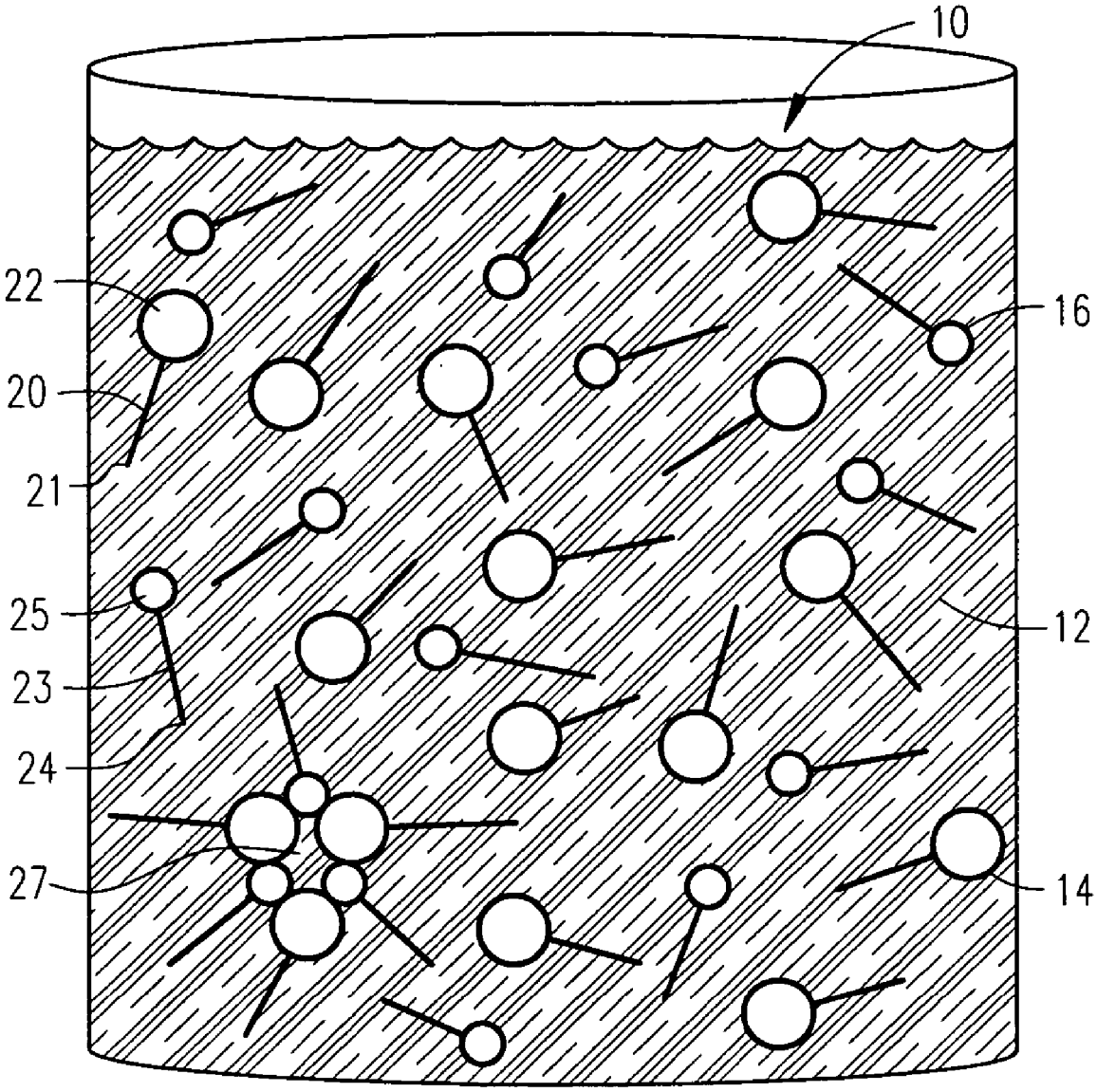
FIG. 1 is a schematic view illustrating a composition for forming fibers of synthetic detergents.

Within the context of this specification, each term or phrase below will include the following meaning or meanings:

(a) "Surfactant", or "surface active agent", includes compounds that reduce the surface tension when dissolved in an aqueous media. Surfactant also includes compounds that reduce the surface tension between incompatible or partially incompatible liquid phases, or between a liquid and a solid. Surfactants can function as detergents, emulsifiers, wetting agents and/or suspending agents.

(b) "Surfactant monomers" and variations thereof include a hydrophobic tail portion that is formed of a long chain fatty acid, and a functional head group that is generally hydrophilic. The head group can have a charge that is either positive, negative, or amphoteric. The head group can also have no charge. Some example head groups include sulfates, sulfonates, phosphates, amides and amines (among others). The length and structure of the fatty acid tail portion determines it's hydrophobicity. Some example fatty acids include lauric C12, palimitic C16 and stearic C18 carbon chain lengths (among others).

(c) "Hydrophilic Lipophilic Balance", or "HLB", refers to the balance between the fatty acid tail portion and the functional head group. Some surfactants are more detersive in very oily media (e.g., degreasers), while others are more detersive in aqueous medias (e.g., fabric care, shampoo, skin cleansers, etc).

(d) "Micelle" is an aggregate of surfactants that is formed when surfactant monomers are placed in a liquid media. A micelle generally includes hydrophobic tail portions and hydrophilic head groups of the surfactant monomers. The hydrophobic tail portions tend to orientate themselves next to each other to form a sphere or tube shape such that the hydrophilic head groups form next to each other and face outward. The homogeneous mixture of hydrophilic head groups possess the same ionic charge such that they tend to repel one another within the micelle.

(e) "Synthetic wax" generally includes organic mixtures or compounds that are solid or semi-solid at room temperature. Synthetic waxes are not found in nature, but are synthesized and developed in a laboratory or manufacturing facility. Some example synthetic waxes include ethylenic polymers and polyol ether-esters. Other example synthetic waxes are of a hydrocarbon type.

(f) "Primary Surfactant" is the most abundant surfactant monomer in a composition. The primary surfactant controls micelle formation in liquid media and generally provides the detersive or emulsifying activity. Primary surfactant refers to a surfactant molecule that has a cationic or anionic charge.

(g) "Secondary Surfactant" refers to a surfactant molecule that has no charge or amphoteric charge. The neutral or nonionic surfactant monomers generally orientate themselves within the micelles to provide an ionic insulating factor. The neutral or nonionic surfactant monomers allow the micelles to form more quickly and function more efficiently (i.e. improved solubility, detersive activity and emulsifying).

DESCRIPTION OF THE INVENTION

FIG. 1 illustrates a composition 10 for forming fibers of synthetic detergents. The composition 10 includes a synthetic wax 12 and a primary surfactant 14 that is added to the synthetic wax 12. The composition 10 further includes a secondary surfactant 16 that is added to the synthetic wax 12. In the illustrated example embodiment, the primary surfactant 14 and the secondary surfactant 16 are embedded in the synthetic wax 12.

In some sample forms, the primary surfactant 14 includes a surfactant monomer 20 having a hydrophobic tail portion 21 and a hydrophilic head group 22. As an example, the hydrophobic tail portion 21 may be formed of a long chain fatty acid, and the hydrophilic head group 22 may be a sulfate.

In addition, the secondary surfactant 16 may include a surfactant monomer 23 having a hydrophobic tail portion 24 and a hydrophilic head group 25. As an example, the hydrophobic tail portion 24 may be formed of a long chain fatty acid, and the hydrophilic head group 25 may be alkanolamides, amine oxides, esters and ethers (among others).

Figure 3:
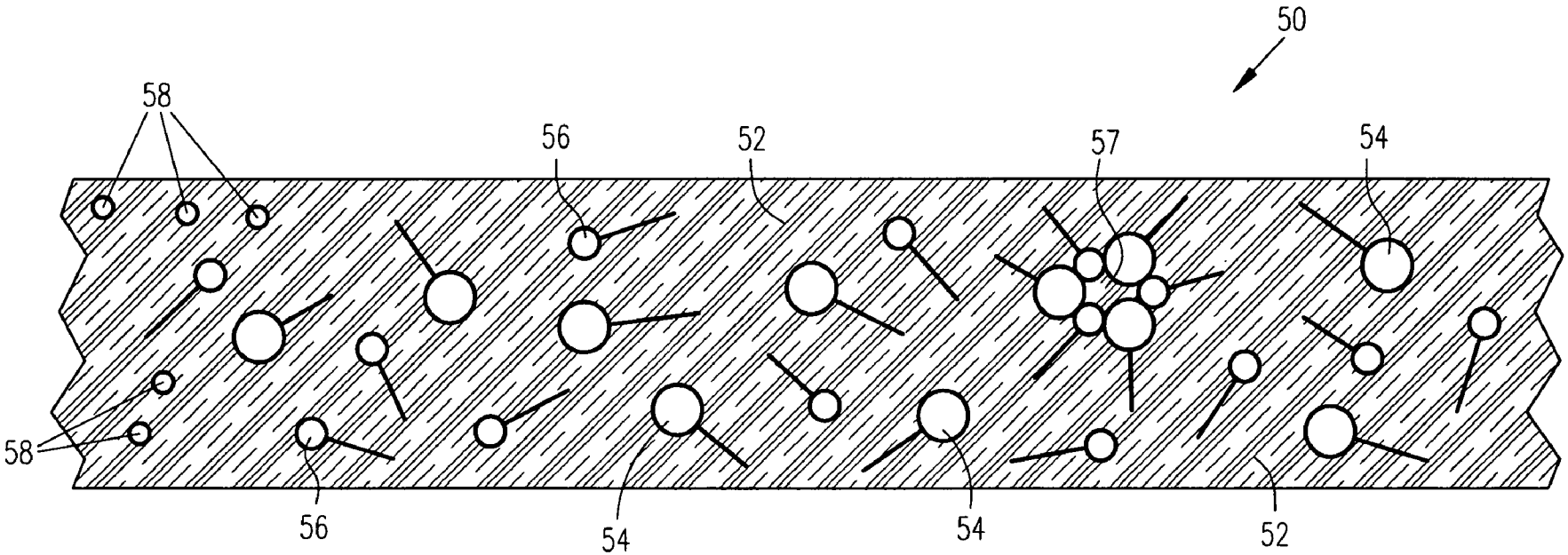
FIG. 3 is a schematic view illustrating a portion of a fiber.

The primary and secondary surfactant form micelles 27 (one example micelle 27 shown in FIG. 1 and one example micelle 57 shown in FIG. 3). The micelles are formed when the composition 10 is placed in a liquid media. The hydrophobic tail portions 21, 24 of the primary and secondary surfactants 14, 16 tend to orientate themselves in close proximity to each other to form a sphere or tube shape. In addition, the hydrophilic head groups 22, 25 form next to each other and face outward. The homogeneous mixture of hydrophilic head groups 22, 25 possess the same ionic charge such that they tend to repel one another within the respective micelles.

In some forms, the synthetic wax 12 may be an ethylenic polymer. The type of synthetic wax will be selected based on (i) processing parameters; (ii) dispensing characteristics; (iii) package issues; and (iv) solubility.

In addition, the synthetic wax should have the properties that are required for a particular product and/or process application (e.g., laundry detergent, dish detergent and hard surface or skin cleansers). The synthetic wax properties can be controlled at the molecular level to define properties such as melting temperature, shear strength, viscosity, crystallinity, solid phase matrix, hardness, tackiness and heat stability among other properties.

The composition 10 may include one or more suitable primary and secondary surfactants 14, 16. As an example, the surfactants 14, 16 may include a hydrophilic portion, such as sulfates, phosphates, sulfonates, ethoxylates, amids and amines (among others) that are attached to a hydrophobic fatty acid portion which includes carbon chain lengths from C6–C22. In some forms, the hydrophobic fatty acid chains may be ethoxylated (ethylene oxide), or contain additional functional groups that provide alternate benefits (e.g., making the composition suitable for commerce).

It should be noted that one or more of the synthetic wax 12, the primary surfactant 14 and the secondary surfactant 16 may be partially, or wholly, soluble in aqueous media. In some forms, the primary surfactant 14 and/or the secondary surfactant 16 are at least partially, or wholly, soluble in the synthetic wax 12, while in other forms the primary surfactant 14 and/or the secondary surfactant 16 are suspended in the synthetic wax 12. The number and quantity of synthetic waxes, primary surfactants and secondary surfactants that are included in the composition 10 will be based on the properties that are desired within particular commercial products.

Figure 2:
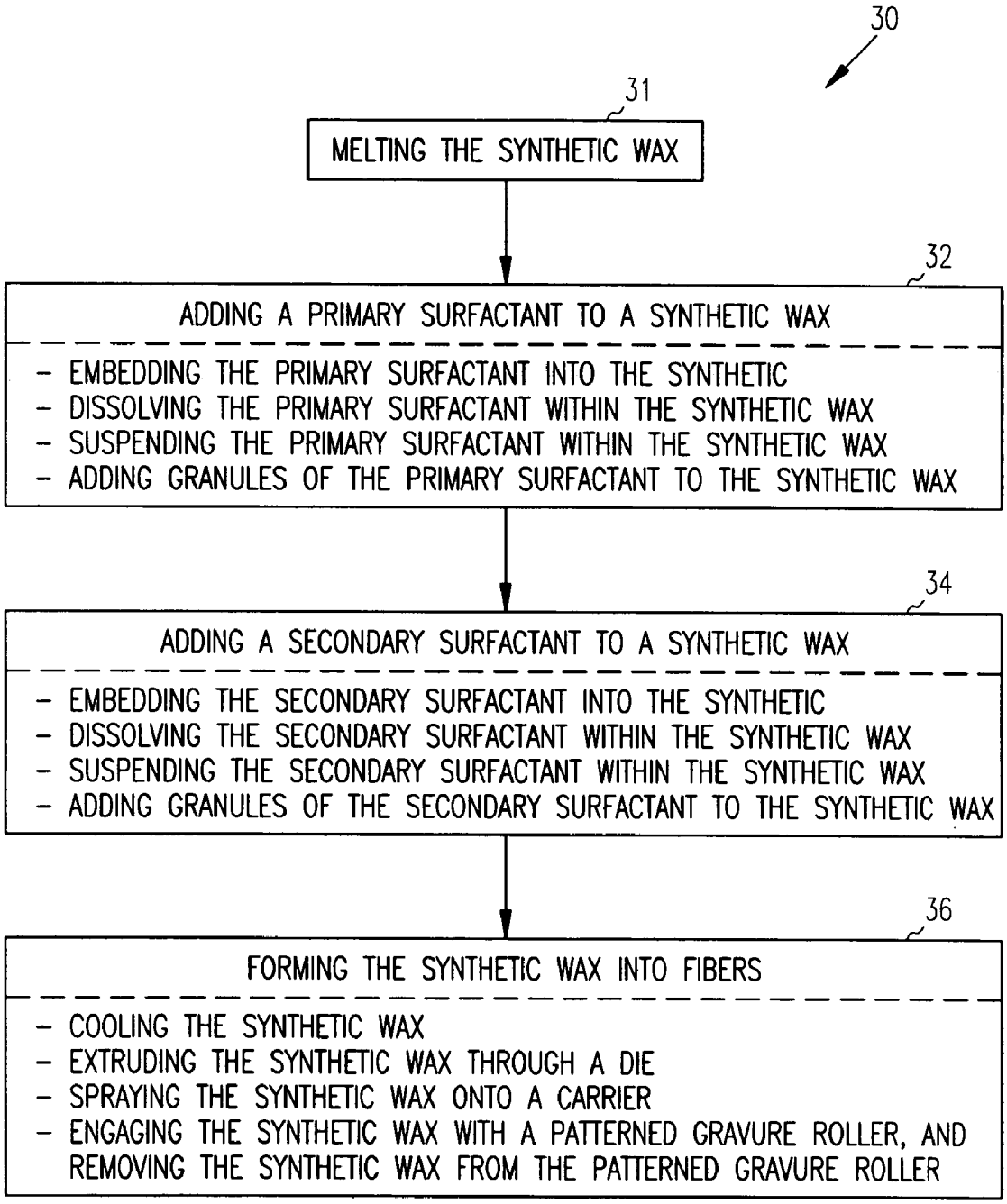
FIG. 2 is a flow diagram illustrating a method for developing fibers of synthetic detergents.

FIG. 2 illustrates a method 30 for developing fibers of synthetic detergents. The method 30 includes adding a primary surfactant to a synthetic wax [32] and adding a secondary surfactant to the synthetic wax [34]. The method further includes forming the synthetic wax into fibers [36].

The method may further include melting the synthetic wax [31]. In some forms of the method, forming the synthetic wax into fibers includes cooling the synthetic wax.

Adding the primary surfactant [32] and adding the secondary surfactant to the synthetic wax [34] may include (i) embedding the primary surfactant and/or the secondary surfactant into the synthetic wax; (ii) dissolving the primary surfactant and/or the secondary surfactant into the synthetic wax; (iii) suspending the primary surfactant and/or the secondary surfactant within the synthetic wax; and/or (iv) adding granules of the primary surfactant and/or granules of the secondary surfactant to the synthetic wax.

In addition, forming the synthetic wax into fibers [36] may include (i) extruding the synthetic wax through a die; (ii) spraying the synthetic wax onto a wire or fabric carrier and removing the synthetic wax from the carrier; or (iii) engaging the synthetic wax with a patterned gravure roller and removing the synthetic wax from the patterned gravure roller.

It should be noted that the synthetic wax may be in liquid, semi-solid or solid form when the primary surfactant and the secondary surfactant are added to the synthetic wax. In addition, the primary surfactant and the secondary surfactant may be in liquid or solid form when the primary surfactant and the secondary surfactant are added to the synthetic wax.

Some example primary surfactants that are suitable for operation with the methods of the present invention include sulfates, phosphates, sulfonates and ethoxylates versions of each ingredient. Some example secondary surfactants that are suitable for operation with the methods of the present invention include long chain fatty acid alcohols, alkanolamides, amine oxides, esters and ethers (among others).

The type, number and quantity of primary and secondary surfactants will be based in large part on the hydrophilic lipophilic balance, or "HLB", of each surfactant. The HLB determines the water solubility and/or oil solubility properties of each surfactant. Some properties may be desirable within certain commercial products that would be produced using the fibers formed by the method. As an example, some surfactants function more effectively as degreasers while others are more detersive in aqueous medias (e.g., shampoo).

FIG. 3 illustrates a fiber 50 that includes a synthetic wax 52 and a primary surfactant 54 embedded in the synthetic wax 52. The fiber 50 further includes a secondary surfactant 56 embedded in the synthetic wax 52.

In some sample forms of the fiber 50, the primary surfactant 54 includes a surfactant monomer having a hydrophobic tail portion and a hydrophilic head group. As an example, the hydrophobic tail portion may be formed of a long chain fatty acid, and the hydrophilic head group may be a sulfate.

In addition, the secondary surfactant 56 embedded in the fiber 50 may include a surfactant monomer having a hydrophobic tail portion and a hydrophilic head group. As an example, the hydrophobic tail portion may be formed of a long chain fatty acid, and the hydrophilic head group may be alkanolamides, amine oxides, esters and ethers (among others).

In some forms of the fiber 50, the synthetic wax 52 may be an ethylenic polymer. The type of synthetic wax 52 will be selected based on (i) processing parameters; (ii) dispensing characteristics; (iii) package issues; and/or (iv) solubility. As an example, the synthetic wax 52 without the primary and secondary surfactants 54, 56 added will have a melting temperature of about 180 degrees Fahrenheit.

It should be noted that at least some of the primary surfactant 54 may be wholly embedded in the synthetic wax 52, and/or at least some of the secondary surfactant 56 may be wholly embedded in the synthetic wax 52. In addition, the synthetic wax 52, the primary surfactant 54 and/or the secondary surfactant 56 may be partially, or wholly, soluble in aqueous media. In some forms, the primary surfactant 54 and/or the secondary surfactant 56 are at least partially, or wholly, dissolved in the synthetic wax 52, while in other forms the primary surfactant 54 and/or the secondary surfactant 56 are suspended in the synthetic wax 52. As an example, the fiber 50 may be in a substantially cylindrical form.

The fiber 50 may further include other cleaning related ingredients 58, such as brighteners, soil anti-redeposit ion agents, color preservatives, stain removal enzymes, fabric maintenance enzymes, metal chelating agents, water hardness adjusting agents, dyes, perfumes and combinations thereof. The fiber 50 could also be pre-applied to items as a pre-treatment before washing to loosen stains or soils from articles to be cleaned.

When the fiber 50 is used for laundry washing applications, the fiber 50 could include smaller absorbent fibers (not shown) that scavenge dyes which bleed from the clothes during washing. These smaller absorbent fibers could be used to reduce the amount of dye that is undesirably redeposited onto woven or non-woven materials within the laundry. In some forms, the fiber 50 may include a fabric softener and/or a brightening agent that is released after the wash cycle to soften and/or brighten the fabric. In another example, the fiber 50 may include a fabric treatment agent (e.g., a stain repellent and/or an anti-wrinkling agent) that is released relatively late in the wash cycle.

The fiber 50 may also include pH adjusting agents that are released at a slow rate to raise or lower the pH of the washing water. The pH of the washing water would be manipulated to optimize enzyme and stain removal performance.

In addition, the fiber 50 may include foam stabilizers, foam inhibitors or controlled release agents to modify or promote long-term release of the detergents. As an example, controlling the release of the detergents may eliminate the need for a separate soap dispenser in dishwashers, laundry washers or any other machine that includes a soap dispenser. In another example, fiber 50 may be designed to break down when introduced to bleach over a specific time thereby delaying the release of one or more ingredients until most of the bleach is exhausted.

In some forms, functional groups, or ethoxylation and/or propoxylation, can be included in the synthetic wax to increase solubility in aqueous solutions or other polar solvents as well as to provide compatibility with lipophilic solutions or structures (e.g., fibers). In some example embodiments, the fiber 50 that is formed in part by the synthetic wax 52 may solidify at approximately 120 degrees Fahrenheit after the primary and secondary surfactants 54, 56 are added.

When the fiber 50 is to be used in products relating to skin care, the secondary surfactants 56 are typically nonionic or amphoteric to provide a milder, less irritating detergent, especially when anionic charged surfactants (e.g., sodium lauryl sulfate) are used as a primary surfactant 54. This type of primary and secondary surfactant 54, 56 combination can be used with a particular synthetic wax 52 to control the solubility of the fiber 50 in water or some other media.

Figure 4:
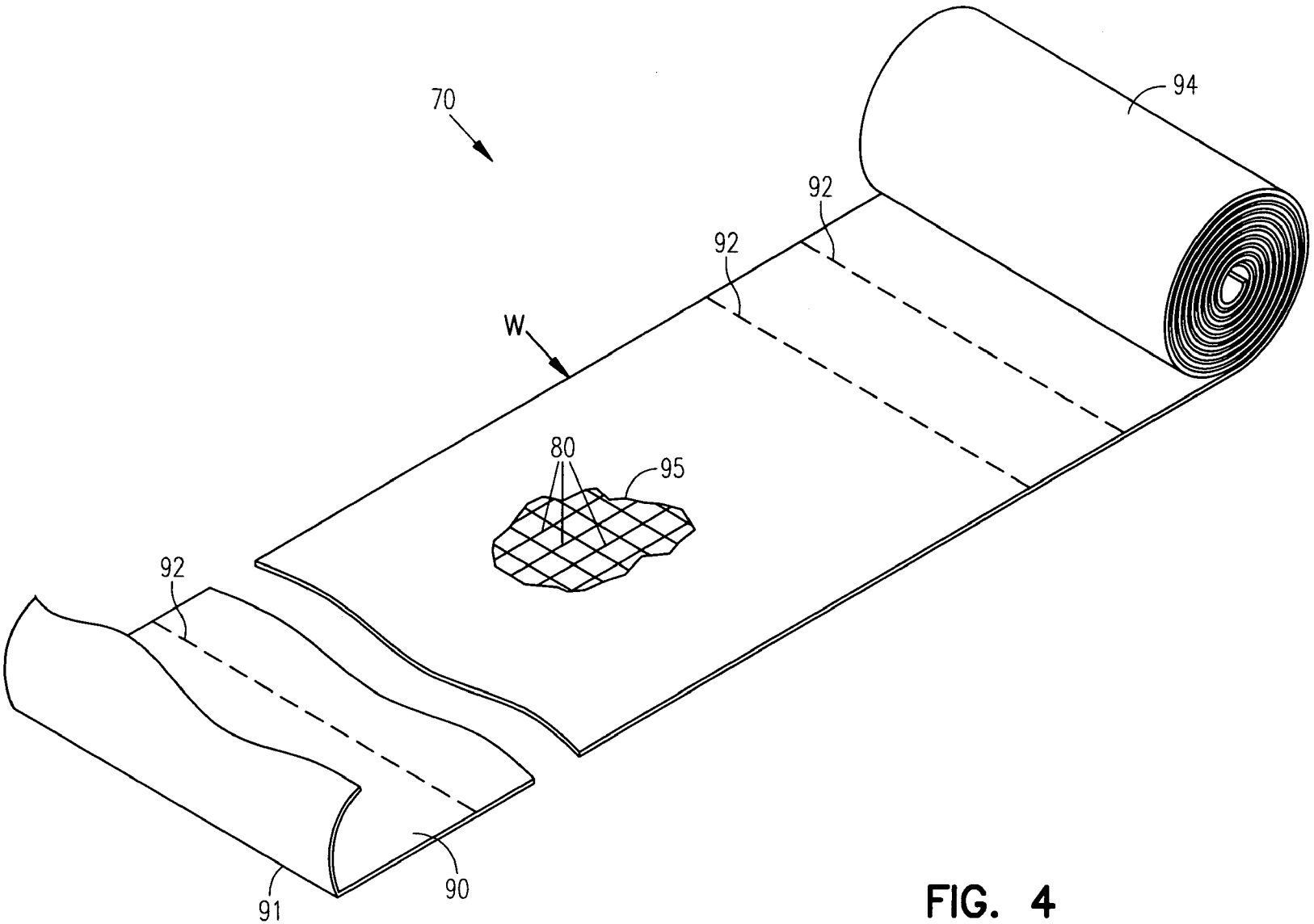
FIG. 4 is a schematic perspective view illustrating a fibrous matrix of synthetic detergents.

FIG. 4 illustrates a fibrous matrix 70 of synthetic detergents. The fibrous matrix includes fibers 80 that are formed of a synthetic wax. A primary surfactant is embedded in the fibers and a secondary surfactant is embedded in the fibers 80.

It should be noted that fibers 80 may be any combination of one or more of fibers described herein (see, e.g., fiber 50 in FIG. 3). The number and quantity of synthetic waxes, primary surfactants and secondary surfactants that are included in the fibers 80 that form the fibrous matrix 70 will be based on the properties that are desired within particular commercial products.

In the embodiment illustrated in FIG. 4, the fibers 80 are formed into a web W. The web W may be cut into one or more sheets 90 that may include at least one fold 91 and/or at least one perforation 92.

As illustrated in FIG.4, the sheet 90 may be part of a continuous web W that may be formed into, or feed out from, a continuous roll 94. Although the fibers 80 are shown as being arranged in an orthogonal pattern 95, the fibers 80 may be arranged in any orientation that facilitates processing. In addition, the fibers 80 may be continuous or discontinuous depending on the application where the fibrous matrix 70 will be used.

In some forms, the sheets 90 that are formed by the fibers 80 are essentially dry and lightweight such that the sheets 90 can be readily stacked for packaging or formed into continuous roll 94. In some forms, the fibrous matrix 70 may be inter-folded, o-folded and/or compressed into various geometric shapes. In addition, when the fibrous matrix 70 is formed into sheets that are stacked, the sheets may be separated by a water-soluble substrate that serves as a barrier between the sheets.

In some forms, the fibers that form the sheets may include an additional cleaning ingredient and/or an odor control ingredient (e.g., nanoparticulates). As an example, the sheets may be stored in a laundry hamper, basket or vessel that includes items (e.g., clothes) to be cleaned. Storing sheets that include an odor control ingredient with the items to be cleaned serves to reduce odors prior to cleaning.

The fibrous matrix 70 may be formed by extruding the synthetic wax through a die, while in other forms the synthetic wax may be sprayed onto a solid or mesh-like carrier (not shown). Some example carriers include a forming wire, a moving porous web and/or a chilled roll. Depending on how the fibrous matrix 70 is formed, the fibrous matrix 70 may be solidified, or quenched, using forced air, convection and/or heat.

In some forms, the fibers 80 may be formed into a fiber matrix 70 using pressure. In addition, the fiber matrix 70 may be embossed with logos, use instructions or any other design or information. The embossing may at least partially serve to form the fibers 80 into the fiber matrix 70.

It should be noted that printing technology may be used to form and create the fibrous matrix 70. As an example, synthetic wax may be applied to one or more patterned gravure type printing rollers (not shown). The synthetic wax would then be removed from the roller(s) and then placed onto a carrier (e.g., a conveyor).

While the invention has been described in detail with respect to specific embodiments, it will be appreciated that there are variations of, and equivalents to these embodiments. Accordingly, the scope of the present invention should be determined by the appended claims and any equivalents thereto.

What is claimed is:

1. A fibrous matrix of synthetic detergents, the fibrous matrix comprising:

fibers formed of a synthetic wax, wherein the fibers are completely soluble in aqueous media;

a primary surfactant embedded in the fibers; and a secondary surfactant embedded in the fibers.

2. The fibrous matrix of claim 1 wherein the primary surfactant includes a surfactant monomer having a hydrophobic tail portion and a hydrophilic head group.

3. The fibrous matrix of claim 1 wherein the secondary surfactant includes a surfactant monomer having a hydrophobic tail portion and a hydrophilic head group.

4. The fibrous matrix of claim 1 wherein the synthetic wax is an ethylenic polymer.

5. The fibrous matrix of claim 1 wherein the fibers form a sheet.

6. The fibrous matrix of claim 5 wherein the sheet includes at least one fold.

7. The fibrous matrix of claim 5 wherein the sheet includes at least one perforation.

8. The fibrous matrix of claim 1 wherein the fibers form a continuous web.

9. The fibrous matrix of claim 8 wherein the continuous web is formed into a roll.

10. The fibrous matrix of claim 1 further comprising at least one additional ingredient embedded in the fibers.

11. The fibrous matrix of claim 1 wherein the at least one additional ingredient is an odor control ingredient.

12. The fibrous matrix of claim 1 wherein the fibers are in a substantially cylindrical form.

13. A fibrous matrix of synthetic detergents, the fibrous matrix comprising:

fibers formed of a synthetic wax, wherein the fibers are completely soluble in acqueous media;

a primary surfactant embedded in the fibers; and a secondary surfactant embedded in the fibers, wherein the primary surfactant and the secondary surfactant are suspended in the fibers.

14. A fibrous matrix of synthetic detergents, the fibrous matrix comprising:

fibers formed of a synthetic wax, wherein the fibers are completely soluble in acqueous media;

a primary surfactant embedded in the fibers; and a secondary surfactant embedded in the fibers, wherein the primary surfactant and the secondary surfactant are dissolved within the fibers.

15. A fibrous matrix of synthetic detergents, the fibrous matrix comprising:

fibers formed of a synthetic wax, wherein the fibers are completely soluble in acqueous media;

a primary surfactant embedded in the fibers; and a secondary surfactant embedded in the fibers, wherein the fibers are arranged in an orthogonal pattern.

* * * * *